US007841196B2

(12) United States Patent
Hatano et al.

(10) Patent No.: US 7,841,196 B2
(45) Date of Patent: Nov. 30, 2010

(54) VARIABLE-CAPACITY AIR CONDITIONER

(75) Inventors: Koji Hatano, Shiga (JP); Hideyuki Kanzaki, Shiga (JP); Yoshihito Yamada, Shiga (JP)

(73) Assignee: Panasonic Corporation, Osaka (JP)

( * ) Notice: Subject to any disclaimer, the term of this patent is extended or adjusted under 35 U.S.C. 154(b) by 657 days.

(21) Appl. No.: 11/619,657

(22) Filed: Jan. 4, 2007

(65) Prior Publication Data

US 2007/0151267 A1 Jul. 5, 2007

(30) Foreign Application Priority Data

Jan. 5, 2006 (JP) ..... 2006-000353

(51) Int. Cl.
*F25B 49/00* (2006.01)
*F25B 49/02* (2006.01)

(52) U.S. Cl. ..... 62/197; 62/228.1

(58) Field of Classification Search ..... 62/197, 62/228.1, 230, 228.5
See application file for complete search history.

(56) References Cited

U.S. PATENT DOCUMENTS 2,453,131 A * 11/1948 Hubbard ..... 62/197
2,667,757 A * 2/1954 Shoemaker ..... 62/152
2,691,872 A * 10/1954 Schaefer ..... 62/329
2,693,679 A * 11/1954 Staebler ..... 62/161
3,150,502 A * 9/1964 Tucker ..... 62/197
4,939,909 A * 7/1990 Tsuchiyama et al. ..... 62/158
5,077,983 A * 1/1992 Dudley ..... 62/228.1
5,357,766 A * 10/1994 Shiraishi et al. ..... 62/197
6,314,750 B1 * 11/2001 Ishikawa et al. ..... 62/324.1
7,562,536 B2 * 7/2009 Harrod et al. ..... 62/228.1
7,574,872 B2 * 8/2009 Moon et al. ..... 62/196.3
7,610,766 B2 * 11/2009 Dube ..... 62/151
2001/0022090 A1 * 9/2001 Takano et al. ..... 62/228.5
2001/0035016 A1 * 11/2001 Weber et al. ..... 62/210
2002/0069654 A1 * 6/2002 Doi et al. ..... 62/199
2002/0078699 A1 * 6/2002 Vogel et al. ..... 62/151
2002/0170301 A1 * 11/2002 Loprete et al. ..... 62/175
2003/0048203 A1 * 3/2003 Clary et al. ..... 340/945
2005/0086960 A1 4/2005 Yokozeki et al.
2005/0210898 A1 * 9/2005 Bae et al. ..... 62/197

(Continued)

FOREIGN PATENT DOCUMENTS

CN 1190723 A 8/1998

(Continued)

*Primary Examiner*—Frantz F Jules
*Assistant Examiner*—Alexis K Cox
(74) *Attorney, Agent, or Firm*—RatnerPrestia

(57) ABSTRACT

A variable-capacity air conditioner includes a compressor for compressing refrigerant, an indoor heat-exchanger coupled to the compressor, an outdoor heat-exchanger coupled to the compressor, a piping for coupling the compressor, the indoor heat-exchanger, and the outdoor heat-exchanger, a first capillary tube provided in the piping, a second capillary tube provided in the piping in series with the first capillary tube, a by-pass pipe connected in parallel to the second capillary tube, a valve for opening and closing the by-pass pipe, and a controller for controlling the compressor and the valve. The compressor is operable at a first capacity and a second capacity less than the first capacity to compress the refrigerant. The air conditioner prevents the compressor from overload and allows the refrigerant to circulating at an optimal flow amount rate through a refrigeration cycle.

11 Claims, 11 Drawing Sheets

U.S. PATENT DOCUMENTS

2009/0293521 A1 * 12/2009 Major et al. ..... 62/228.1

FOREIGN PATENT DOCUMENTS

JP 52028047 A * 3/1977
JP 59210252 A * 11/1984
JP 2-290471 A 11/1990
JP 06-281296 10/1994
JP 2002-089976 3/2002
KR 100234974 B1 9/1999

* cited by examiner

VARIABLE-CAPACITY AIR CONDITIONER

FIELD OF THE INVENTION

The present invention relates to a variable-capacity air conditioner including a compressor capable of changing its capacity.

BACKGROUND OF THE INVENTION

A conventional variable-capacity air conditioner changes a flow amount of refrigerant by changing a rotation speed of a compressor with an inverter. In order to obtain an optimal flow amount of refrigerant, Japanese Patent Laid-Open Publication No.06-281296 and Japanese Patent Laid-Open Publication No.2002-89976 disclose a mechanically-controlled expansion valve and an electronically-controlled expansion valve which function as throttle valves for controlling the amount of the refrigerant flowing through a refrigerant passage according to a pressure or temperature in a refrigeration cycle, respectively.

The mechanically controlled expansion valve incidentally controls the flow amount of the refrigerant by detecting the pressure or temperature in the refrigeration cycle. When a load to an electric motor driving a compressor drastically and rapidly increases upon the compressor starting up, a discharge pressure of the compressor drastically increases due to a delay of a driving operation, accordingly providing the motor with an overload. The overload may force stopping the motor (breakdown) or activates an overload relay to stop the compressor.

The electronically controlled expansion valve which can avoid the overload described above, however, has a complicated structure and an expensive production cost.

SUMMARY OF THE INVENTION

A variable-capacity air conditioner includes a compressor for compressing refrigerant, an indoor heat-exchanger coupled to the compressor, an outdoor heat-exchanger coupled to the compressor, a piping for coupling the compressor, the indoor heat-exchanger, and the outdoor heat-exchanger, a first capillary tube provided in the piping, a second capillary tube provided in the piping in series with the first capillary tube, a by-pass pipe connected in parallel to the second capillary tube, a valve for opening and closing the by-pass pipe, and a controller for controlling the compressor and the valve. The compressor is operable at a first capacity and a second capacity less than the first capacity to compress the refrigerant.

The air conditioner prevents the compressor from overload and allows the refrigerant to circulate at an optimal flow amount through a refrigeration cycle.

DETAILED DESCRIPTION OF THE PREFERRED EMBODIMENTS

Exemplary Embodiment 1

Figure 1:
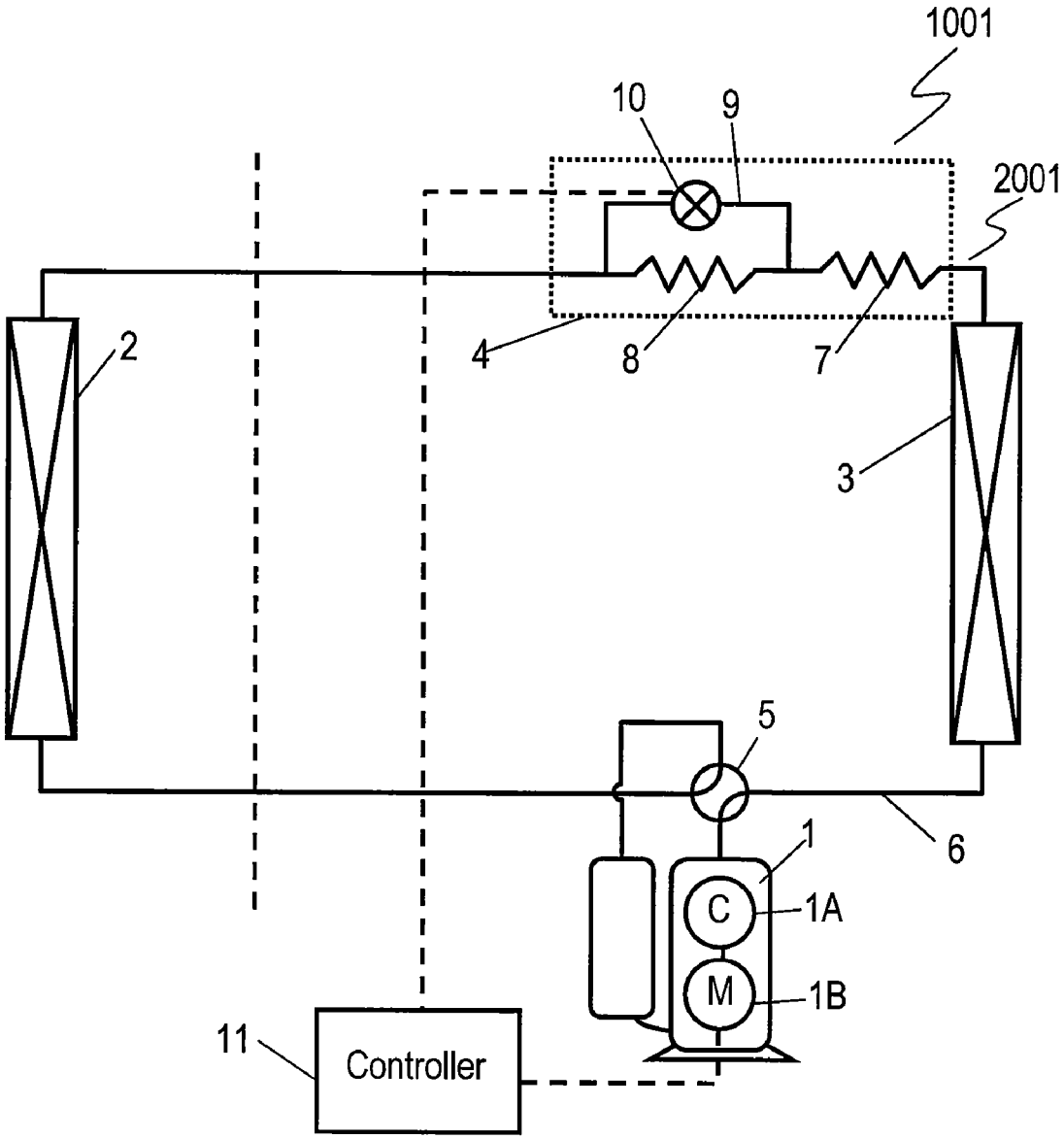
FIG. 1 is a block diagram of the variable-capacity air conditioner according to Exemplary Embodiment 1 of the present invention.

FIG. 1 is a block diagram of refrigeration cycle 2001 of variable-capacity air conditioner 1001 in accordance with Exemplary Embodiment 1 of the present invention. Refrigeration cycle 2001 includes compressor 1, indoor heat-exchanger 2, outdoor heat-exchanger 3, throttle device 4, four-way valve 5, and piping 6 for connecting all the above components. Refrigerant circulates through refrigeration cycle 2001. Controller 11 controls compressor 1 and shutter valve 10. Throttle device 4 includes first capillary tube 7, second capillary tube 8 connected in series with first capillary tube 7, by-pass pipe 9 connected in parallel to second capillary tube 8, and shutter valve 10 provided in by-pass pipe 9. According to Embodiment 1, by-pass pipe 9 and shutter valve 10 are provided in parallel to second capillary tube 8, however, they are not limited to it, and may be provided in parallel to first capillary tube 7. Compressor 1 includes compression element 1A for compressing the refrigerant and motor element 1B for driving compression element 1A.

If the amount of the refrigerant passing through first capillary tube 7 is determined to be suitable for a first volume, the maximum volume of the refrigerant is supplied from compressor 1. When shutter valve 10 is closed, the amount of the refrigerant passing through first capillary tube 7 and second capillary tube 8 is determined so as to be suitable for a second volume of the refrigerant smaller than the first volume is supplied from compressor 1.

Figure 2:
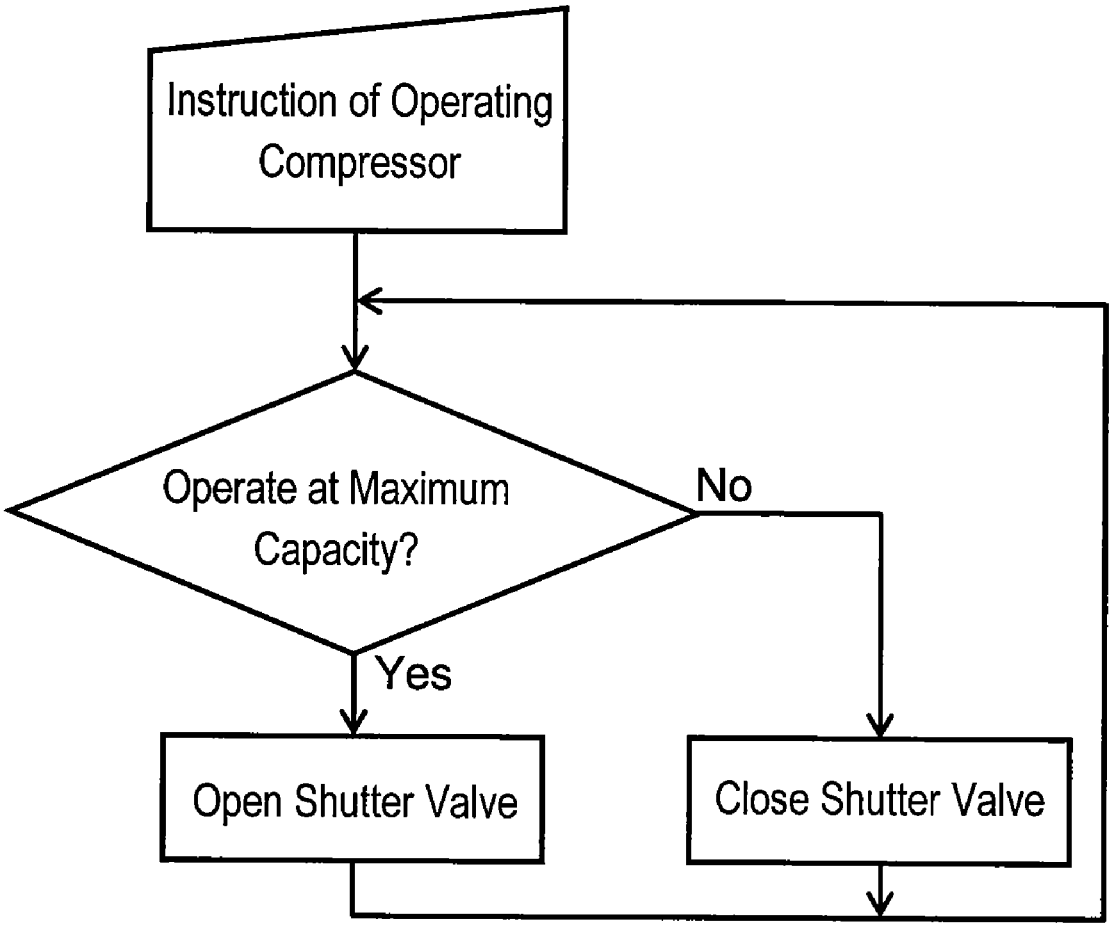
FIG. 2 is a flow chart illustrating an operation of the variable-capacity air conditioner according to Embodiment 1.

FIG. 2 is a flow chart illustrating an operation of variable-capacity air conditioner 1001. When compressor 1 operates at a first capacity as a maximum capacity, controller 11 opens shutter valve 10 and allows the refrigerant to flow in by-pass pipe 9, thereby increasing the flow amount of the refrigerant. In this case, the flow amount of the refrigerant is determined by first capillary tube 7 alone, so that the amount is suitable for the maximum volume of refrigerant. When compressor 1 operates at a second capacity lower than is smaller than the first capacity, controller 11 closes shutter valve 10 to introduce the refrigerant to first capillary tube 7 and second capillary tube 8, thereby limiting the flow amount of the refrigerant in refrigeration cycle 2001 to the flow amount corresponding to the amount discharged. That is, in this case, the flow amount of the refrigerant is the total of respective flow amounts of first capillary tube 7 and second capillary tube 8, so that the flow amount of the refrigerant in refrigeration cycle 2001 is suitable for the second amount smaller than the first amount of the refrigerant at the maximum capacity. The second amount is suitable for the second capacity of compressor 1.

Figure 3:
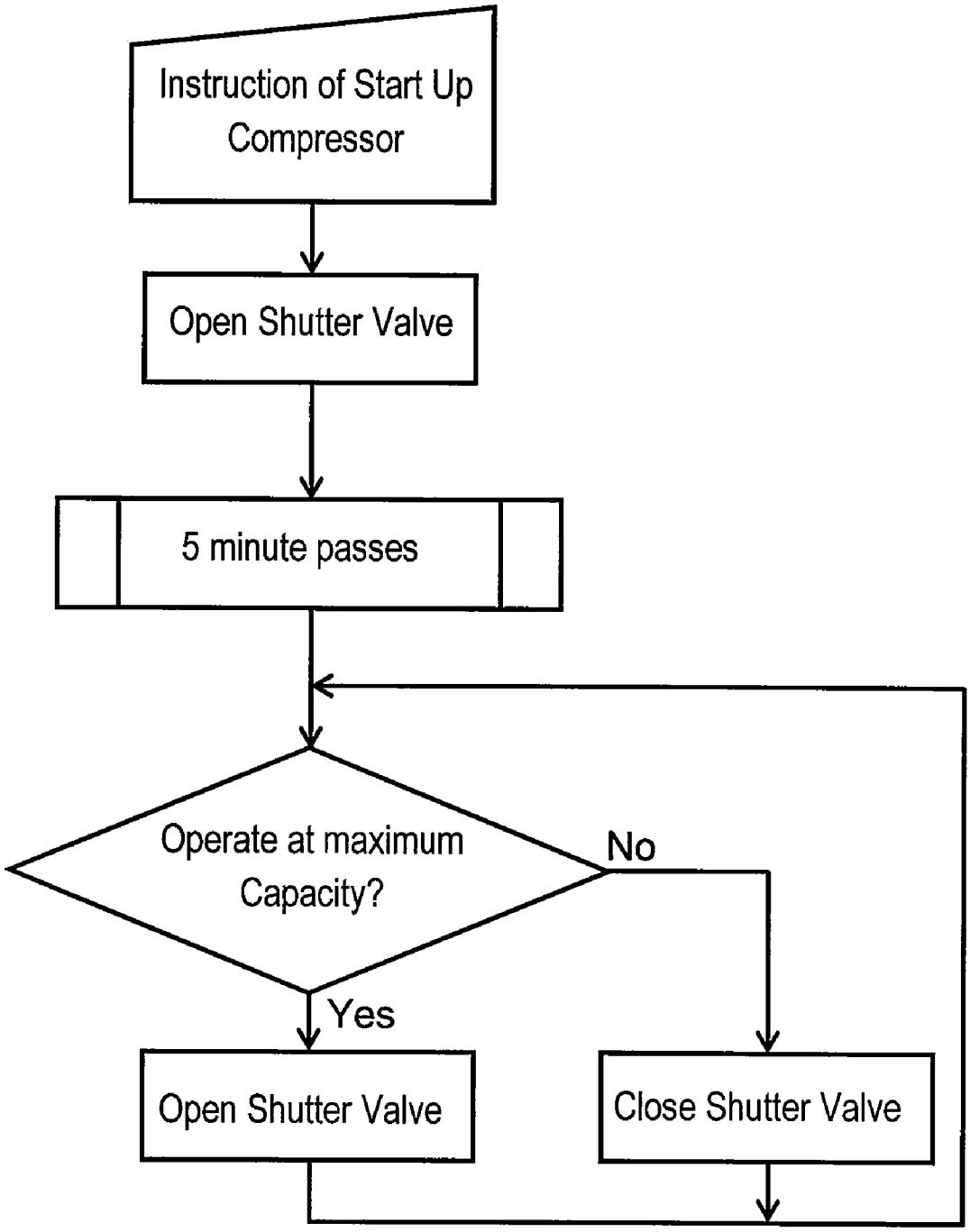
FIG. 3 is a flow chart illustrating a start-up operation of the capacity-variable air conditioner according to Embodiment 1.

FIG. 3 is a flow chart illustrating a start-up operation of compressor 1 of variable-capacity air conditioner 1001. When compressor 1 starts up, compression element 1A receives a large discharge pressure, accordingly providing motor element 1B with abrupt variations in load. When compressor 1 starts up, controller 11 opens shutter valve 10 regardless of the flow amount of the refrigerant to introduce refrigerant to by-pass pipe 9, thereby increasing the flow amount of the refrigerant. This operation protects motor element 1B of compressor 1 from having an overload caused by the abrupt variations in load at the start-up operation. According to Embodiment 1, controller 11 continues to open shutter valve 10 for a predetermined period of time, for example, five minutes. This period is not limited to exactly five minutes and may be determined according to the structure of refrigeration cycle 2001.

Figure 4:
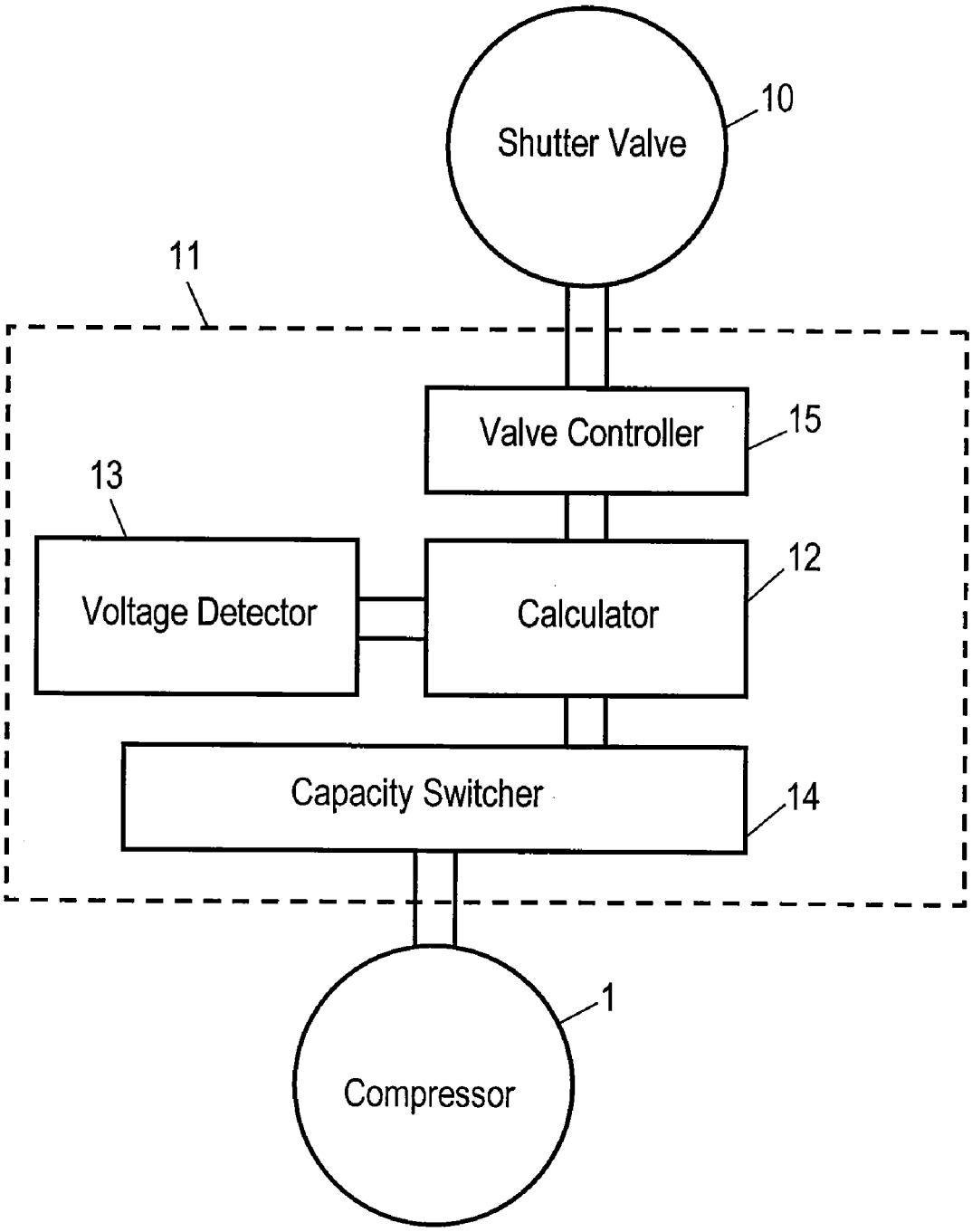
FIG. 4 is a block diagram of a controller of the variable-capacity air conditioner according to Embodiment 1.

FIG. 4 is a block diagram of controller 11. Controller 11 includes calculator 12 formed of electric components including a microprocessor (not shown), voltage detector 13, capacity switcher 14 for changing the amount of the refrigerant supplied from compressor 1, and valve controller 15 for opening and closing shutter valve 10. Calculator 12 controls capacity switcher 14 to change the capacity of compressor 1, i.e., the amount of the refrigerant discharged from compressor 1.

Figure 5:
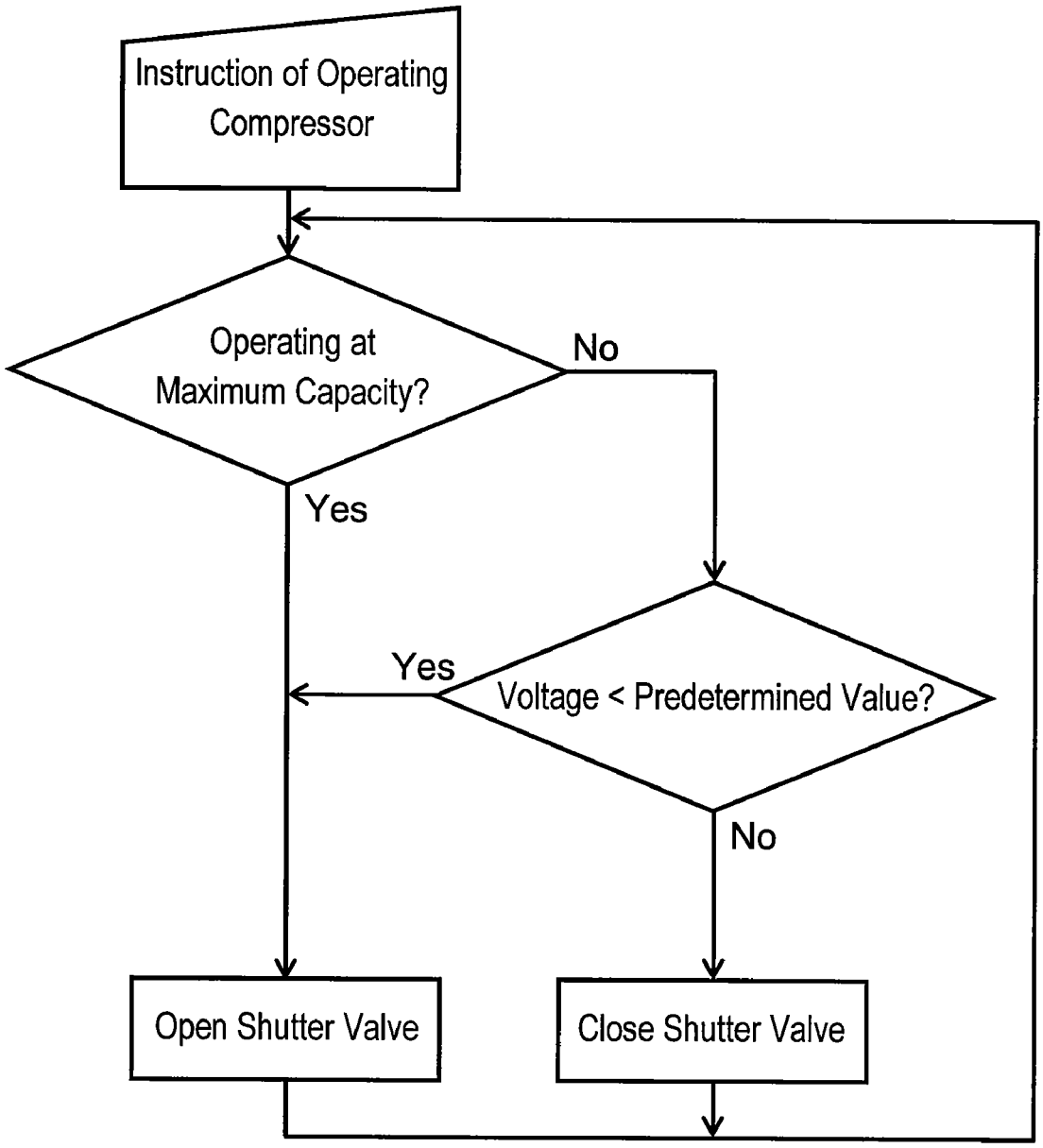
FIG. 5 is a flow chart illustrating an operation of the variable-capacity air conditioner according to Embodiment 1.

FIG. 5 is a flow chart illustrating an operation of variable-capacity air conditioner 1001. This flow chart illustrates how controller 11 controls shutter valve 10 after a lapse of a predetermined period, e.g. five minutes, from the start-up of compressor 1. Voltage detector 13 detects the value of a voltage supplied to motor element 1B of compressor 1 and sends the detected value to calculator 12. When controller 11 controls compressor 1 to discharge the maximum amount, i.e., the first amount, of the refrigerant, calculator 12 instructs valve controller 15 to open shutter valve 10. This operation introduces refrigerant to by-pass pipe 9, thereby increasing the flow amount of the refrigerant. When compressor 1 is controlled to discharge the second amount of the refrigerant smaller than the first amount, if the voltage detected by voltage detector 13 is lower than a predetermined value, calculator 12 instructs valve controller 15 to open shutter valve 10. This operation introduces the refrigerant to by-pass pipe 9, thereby increasing the flow amount of refrigerant. If the value detected by voltage detector 13 is equal to or higher than the predetermined value while the compressor discharges the second amount of the refrigerant, calculator 12 instructs valve controller 15 to close valve 10. This operation prevents the refrigerant from being introduced to by-pass pipe 9, and causes the refrigerant to pass through capillary tubes 7 and 8, thereby reducing the flow amount of the refrigerant. Thus, compressor 1 is prevented from being in an overload state when compressor 1 tends to be in the overload state.

Exemplary Embodiment 2

Figure 6:
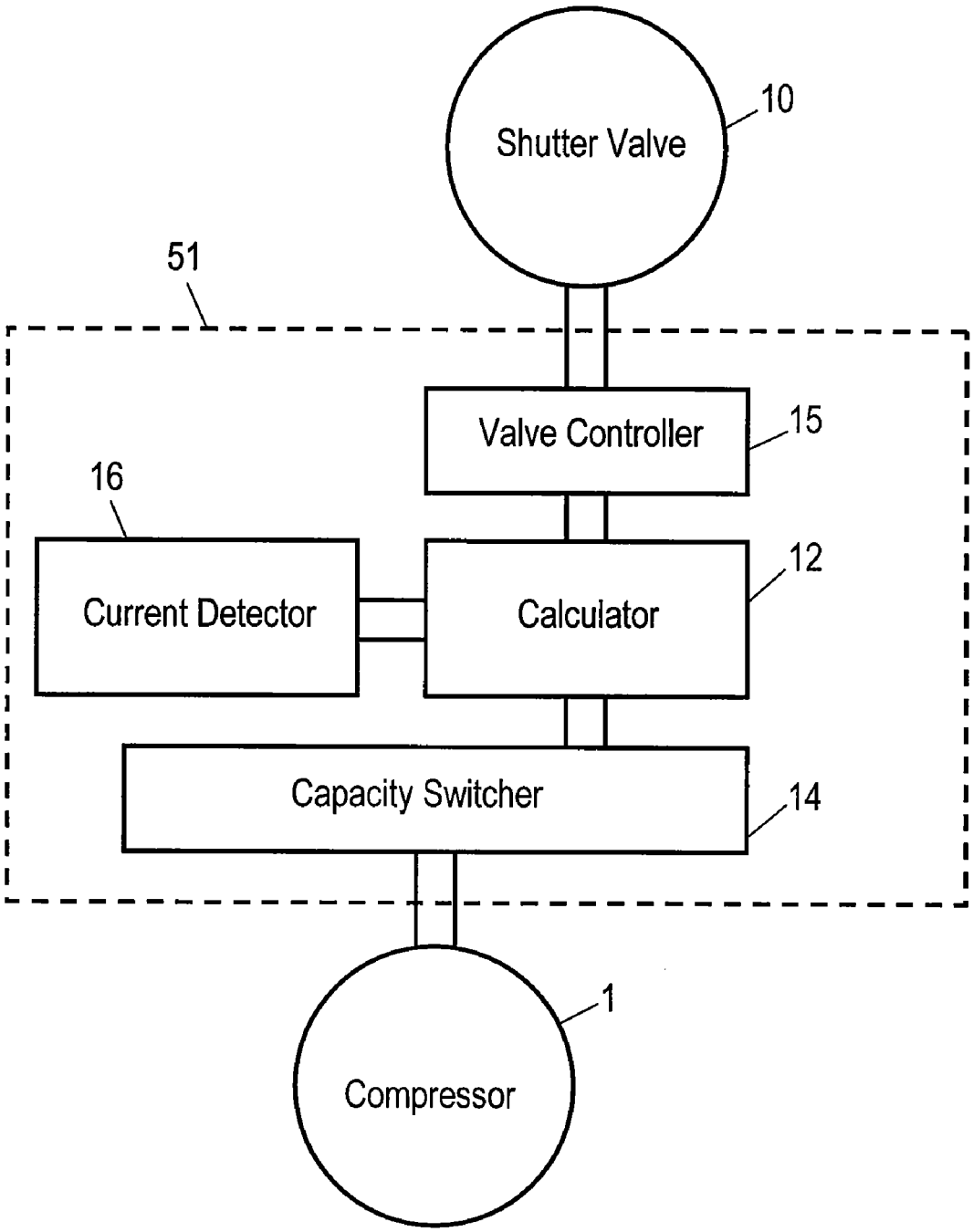
FIG. 6 is a block diagram of a controller of a variable-capacity air conditioner according to Exemplary Embodiment 2 of the invention.

FIG. 6 is a block diagram of controller 51 of a variable-capacity air conditioner according to Exemplary Embodiment 2 of the present invention. In FIG. 6, the same components as those shown in FIG. 4 are denoted by the same reference numerals, and their description will be omitted. The variable-capacity air conditioner of Embodiment 2 includes controller 51 instead of controller 11 shown in FIG. 1. Controller 51 includes current detector 16 instead of voltage detector 13 of controller 11 shown in FIG. 4. Current detector 16 detects a value of a current supplied to motor element 1B of compressor 1.

Figure 7:
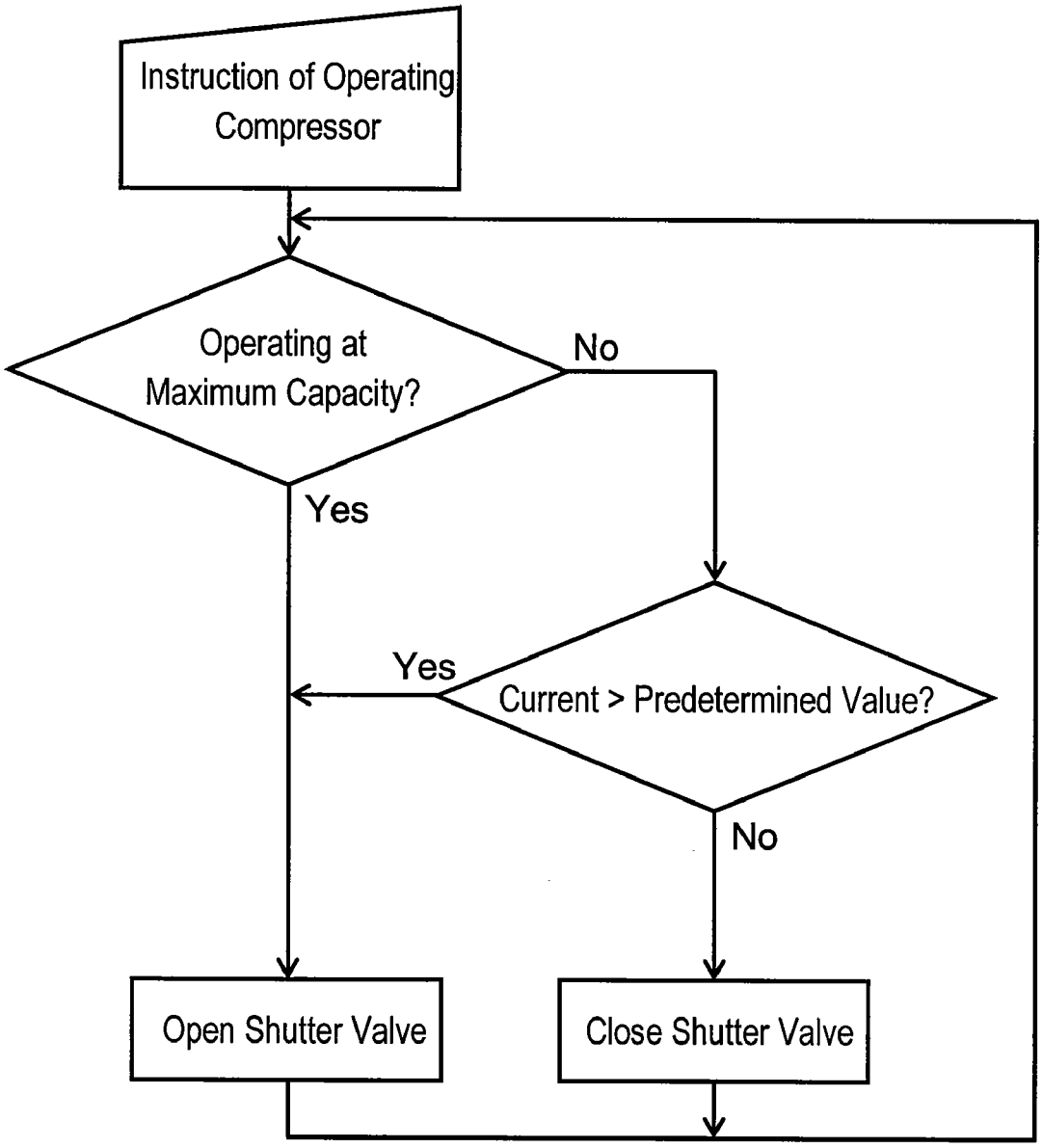
FIG. 7 is a flow chart illustrating an operation of the variable-capacity air conditioner of Embodiment 2.

FIG. 7 is a flow chart illustrating an operation of variable-capacity air conditioner 1002. This flow chart illustrates how controller 51 controls shutter valve 10 after a lapse of a predetermined period, e.g. five minutes, from the start-up of compressor 1. From the starting-up of compressor 1 to the end of the predetermined period, controller 51 opens shutter valve 10 regardless of the capacity of operation of the compressor. Current detector 16 detects the value of a current supplied to motor element 1B of compressor 1 and sends the detected value to calculator 12. When controller 51 controls compressor 1 to discharge the maximum amount, i.e., the first amount, of the refrigerant, calculator 12 instructs valve controller 15 to open shutter valve 10. This operation introduces refrigerant to by-pass pipe 9, thereby increasing the flow amount of the refrigerant. When compressor 1 is controlled to discharge the second amount of the refrigerant smaller than the first amount, if the current detected by current detector 16 is larger than a predetermined value, calculator 12 instructs valve controller 15 to open shutter valve 10. This operation introduces the refrigerant to by-pass pipe 9, thereby increasing the flow amount of refrigerant. If the value detected by current detector 16 is equal to or less than the predetermined value while the compressor discharges the second amount of the refrigerant, calculator 12 instructs valve controller 15 to close valve 10. This operation prevents the refrigerant from being introduced to by-pass pipe 9, and causes the refrigerant to pass through capillary tubes 7 and 8, thereby reducing the flow amount of the refrigerant. Thus, compressor 1 is prevented from being in an overload state when compressor 1 tends to be in the overload state.

Exemplary Embodiment 3

Figure 8:
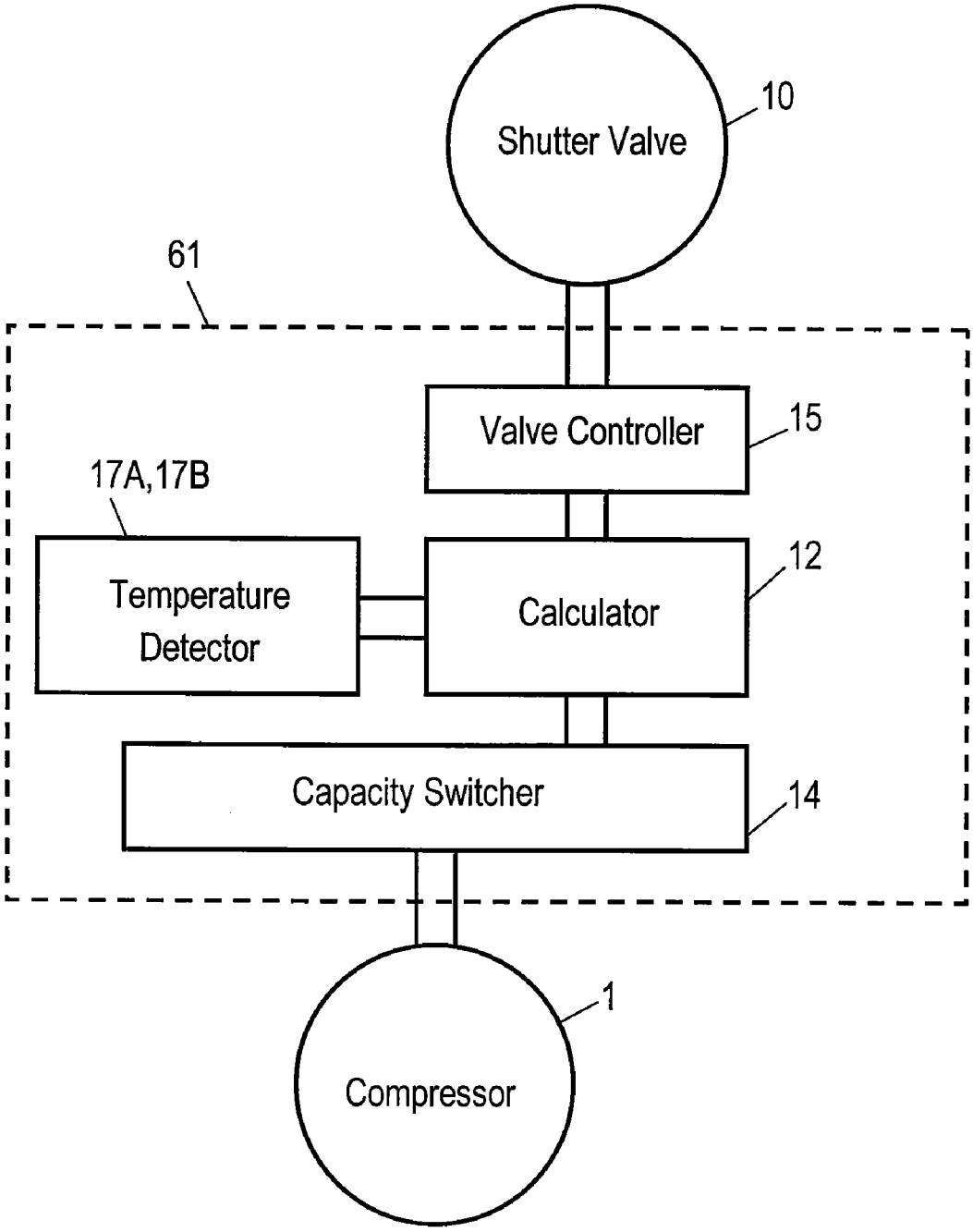
FIG. 8 is a block diagram of a controller of a variable-capacity air conditioner according to Exemplary Embodiment 3 of the invention.

FIG. 8 is a block diagram of controller 61 of a variable-capacity air conditioner according to Exemplary Embodiment 3 of the present invention. In FIG. 8, the same components as those shown in FIG. 4 are denoted by the same reference numerals, and their description will be omitted. The variable-capacity air conditioner of Embodiment 3 includes controller 61 instead of controller 11 in FIG. 1. Controller 61 includes temperature sensors 17A and 17B instead of voltage detector 13 of controller 11 shown in FIG. 4. Temperature sensor 17A is provided at outdoor heat-exchanger 3 to detect the temperature of the refrigerant flowing through outdoor heat-exchanger 3 when the air conditioner operates for cooling. Temperature sensor 17B is provided at indoor heat-exchanger 2 to detect the temperature of the refrigerant flowing through indoor heat-exchanger 2 when the air conditioner operates for heating.

Figure 9:
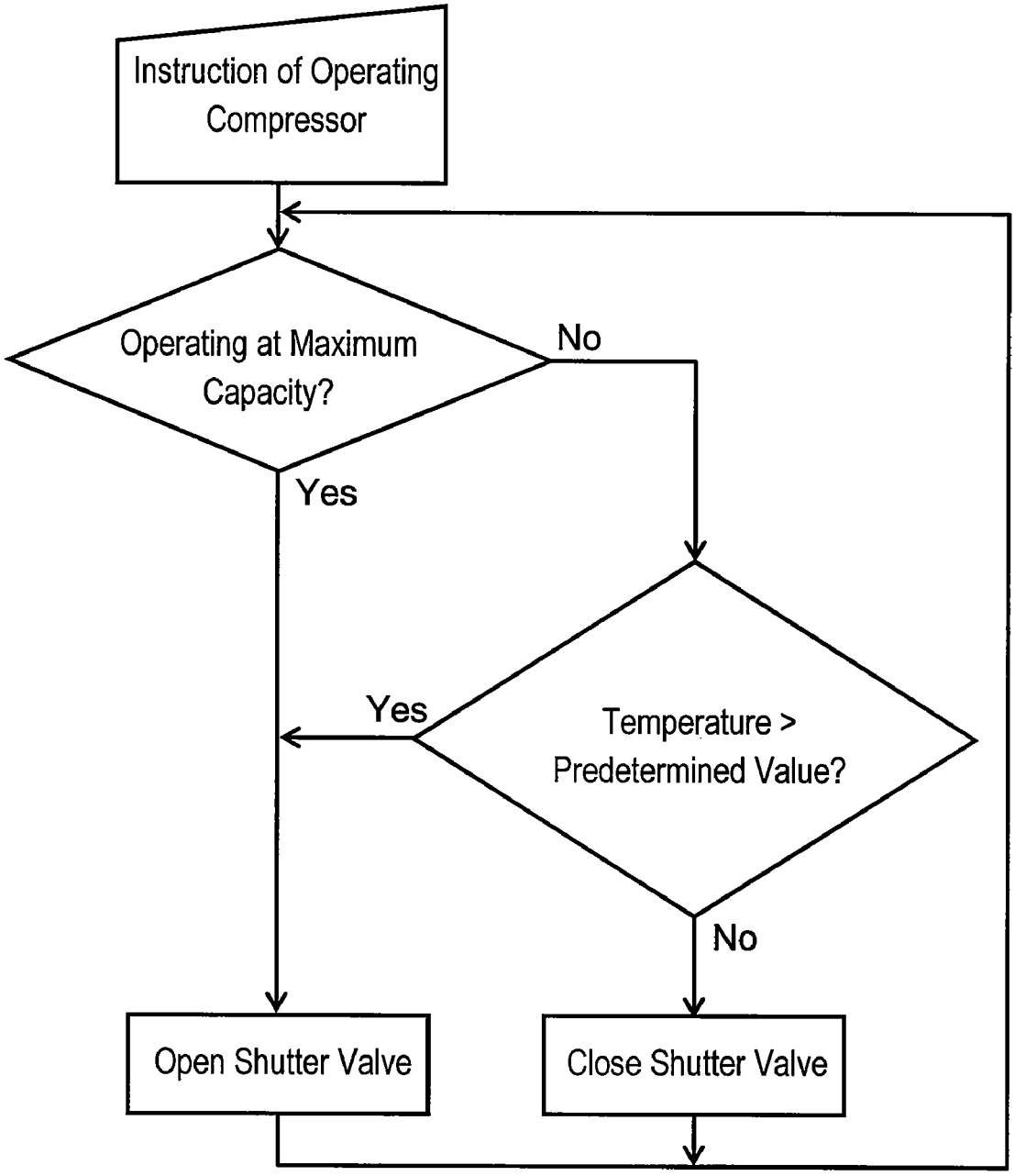
FIG. 9 is a flow chart illustrating an operation of the variable-capacity air conditioner according to Embodiment 3.

FIG. 9 is a flow chart illustrating an operation of the variable-capacity air conditioner of Embodiment 3. This flow chart illustrates how controller 61 controls shutter valve 10 after a lapse of a predetermined period, e.g. five minutes, from the start-up of compressor 1. From the starting-up of compressor 1 to the end of the predetermined period, controller 61 opens shutter valve 10 regardless the capacity of operation of the compressor. Temperature sensors 17A and 17B detects the values of the temperatures, and sends the detected values to calculator 12. When controller 51 controls compressor 1 to discharge the maximum amount, i.e., the first amount, of the refrigerant, calculator 12 instructs valve controller 15 to open shutter valve 10. This operation introduces refrigerant to by-pass pipe 9, thereby increasing the flow amount of the refrigerant.

During the cooling operation, when compressor 1 is controlled to discharge the second amount rate of the refrigerant smaller than the first amount rate, if the temperature detected by temperature sensor 17A is higher than a predetermined value, calculator 12 instructs valve controller 15 to open shutter valve 10. This operation introduces the refrigerant to by-pass pipe 9, thereby increasing the flow amount rate of refrigerant. If the value detected by temperature sensor 17A is equal to or lower than the predetermined value while the compressor discharges the second amount rate of the refrigerant, calculator 12 instructs valve controller 15 to close valve 10. This operation prevents the refrigerant from being introduced to by-pass pipe 9, and causes the refrigerant to pass through capillary tubes 7 and 8, thereby, reducing the flow amount rate of the refrigerant. Thus, compressor 1 is prevented from being in an overload state when compressor 1 tends to be in the overload state.

During the heating operation, when compressor 1 is controlled to discharge the second amount of the refrigerant smaller than the first amount, if the temperature detected by temperature sensor 17B is higher than a predetermined value, calculator 12 instructs valve controller 15 to open shutter valve 10. This operation introduces the refrigerant to by-pass pipe 9, thereby increasing the flow amount of refrigerant. If the value detected by temperature sensor 17B is equal to or lower than the predetermined value while the compressor discharges the second amount of the refrigerant, calculator 12 instructs valve controller 15 to close valve 10. This operation prevents the refrigerant from being introduced to by-pass pipe 9, and causes the refrigerant to pass through capillary tubes 7 and 8, thereby reducing the flow amount of the refrigerant. Thus, compressor 1 is prevented from being in an overload state when compressor 1 tends to be in the overload state.

Exemplary Embodiment 4

Figure 10:
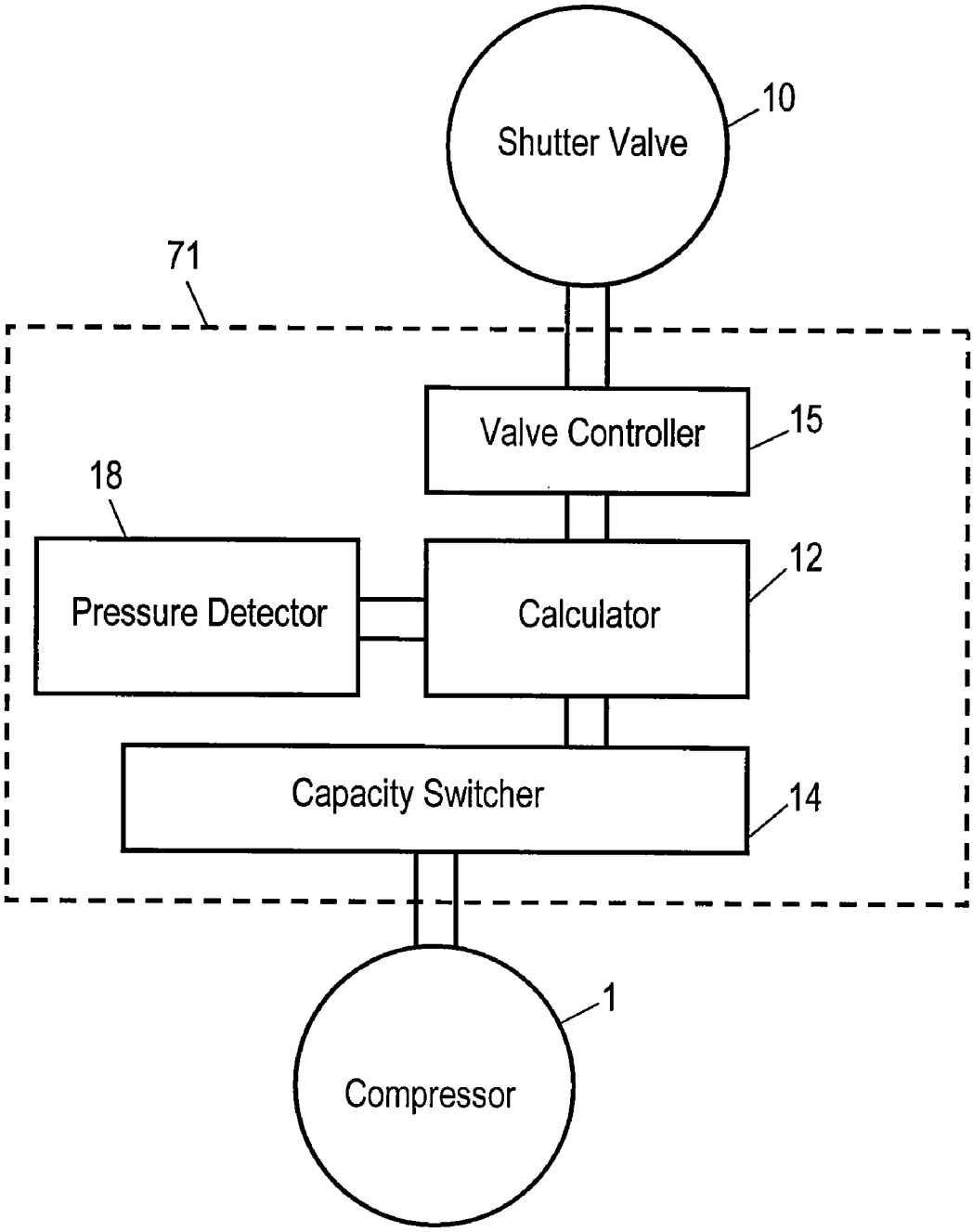
FIG. 10 is a block diagram of a controller of a variable-capacity air conditioner according to Exemplary Embodiment 4.

FIG. 10 is a block diagram of controller 71 of a variable-capacity air conditioner according to Exemplary Embodiment 4 of the present invention. In FIG. 10, the same components as those shown in FIG. 4 are denoted by the same reference numerals, and their description will be omitted. The variable-capacity air conditioner of Embodiment 4 includes controller 71 instead of controller 11 in FIG. 1. Controller 71 includes pressure detector 18 instead of voltage detector 13 of controller 11 shown in FIG. 4. Pressure detector 18 detects a discharge pressure of the refrigerant discharged from compressor 1.

Figure 11:
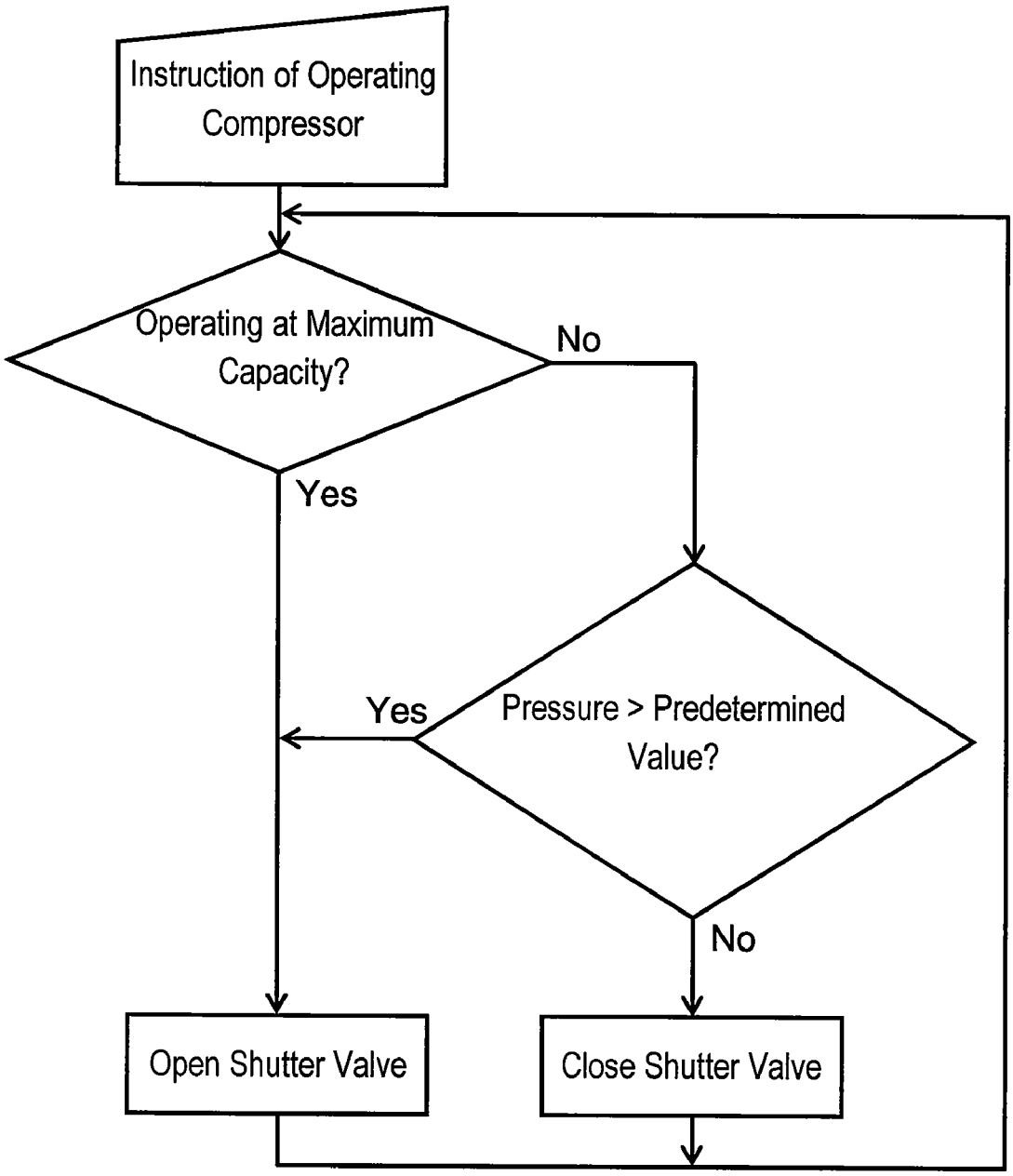
FIG. 11 is a flow chart illustrating an operation of the variable-capacity air conditioner according to Embodiment 4.

FIG. 11 is a flow chart illustrating an operation of the variable-capacity air conditioner of Embodiment 4. This flow chart illustrates how controller 71 controls shutter valve 10 after a lapse of a predetermined period, e.g. five minutes, from the start-up of compressor 1. From the starting-up of compressor 1 to the end of the predetermined period, controller 71 opens shutter valve 10 regardless of the capacity of operation of the compressor. The discharge pressure detected by pressure detector 16 is sent to calculator 12. When controller 71 controls compressor 1 to discharge the maximum amount, i.e., the first amount, of the refrigerant, calculator 12 instructs valve controller 15 to open shutter valve 10. This operation introduces refrigerant to by-pass pipe 9, thereby increasing the flow amount of the refrigerant. When compressor 1 is controlled to discharge the second amount of the refrigerant smaller than the first amount, if the discharge pressure detected by pressure sensor 18 is larger than a predetermined value, calculator 12 instructs valve controller 15 to open shutter valve 10. This operation introduces the refrigerant to by-pass pipe 9, thereby increasing the flow amount of refrigerant. If the value detected by pressure sensor 18 is equal to or less than the predetermined value while the compressor discharges the second amount of the refrigerant, calculator 12 instructs valve controller 15 to close valve 10. This operation prevents the refrigerant from being introduced to by-pass pipe 9, and causes the refrigerant to pass through capillary tubes 7 and 8, thereby reducing the flow amount of the refrigerant. Thus, compressor 1 is prevented from being in an overload state when compressor 1 tends to be in the overload state.

As described, the variable-capacity air conditioners according to Embodiments 1 to 4 properly determine the flow amount rate of the refrigerant according to the operating condition of compressor 1. This operation prevents an overload to compressor 1. The variable-capacity air conditioners are also applicable with the same advantages to devices, such as dehumidifiers, driers, including refrigeration cycles.

The scope of the present invention is not limited by the structures described in the embodiments.

What is claimed is:

1. A variable-capacity air conditioner comprising:

a compressor operable at a first capacity and a second capacity less than the first capacity to compress a refrigerant;

an indoor heat-exchanger coupled to the compressor;

an outdoor heat-exchanger coupled to the compressor;

a piping for coupling the compressor, the indoor heat-exchanger, and the outdoor heat-exchanger;

a first capillary tube provided in the piping;

a second capillary tube provided in the piping, the second capillary tube being connected in series with the first capillary tube;

a by-pass pipe connected in parallel to the second capillary tube;

a valve for opening and closing the by-pass pipe;

a controller for controlling the compressor and the valve such that the variable-capacity air conditioner operates in three stages; and a voltage detector for detecting a voltage applied to the compressor, wherein in a first stage, the controller is programmed to (1) open the valve independent of the detected voltage and (2) operate the compressor at the first capacity independent of the detected voltage, to provide a first flow rate of the refrigerant, in a second stage, the controller is programmed to (1) open the valve when the detected voltage is lower than a predetermined value and (2) operate the compressor at the second capacity independent of the detected voltage, to provide a second flow rate of the refrigerant smaller than the first flow rate, and in a third stage, the controller is programmed to (1) close the valve when the detected voltage is equal to or higher than the predetermined value and (2) operate the compressor at the second capacity independent of the detected voltage, to provide a third flow rate of the refrigerant smaller than the second flow rate.

2. The variable-capacity air conditioner of claim 1, wherein the controller is operable to open the valve regardless of whether the compressor is operating at the first capacity or the second capacity when the compressor starts up.

3. The variable-capacity air conditioner of claim 1, wherein the controller is operable to continue to open the valve open for a predetermined period of time from a start-up operation of the compressor regardless of whether the compressor is operating at the first capacity or the second capacity, open the valve when the compressor operates at the first capacity after a lapse of the predetermined period of time from the start-up, and open the valve when the detected voltage is lower than the predetermined value while the compressor operates at the second capacity after a lapse of the predetermined period of time from the start-up, and close the valve when the detected voltage is equal to or higher than the predetermined value while the compressor operates at the second capacity after a lapse of the predetermined period of time from the start-up.

4. A variable-capacity air conditioner comprising:

a compressor operable at a first capacity and a second capacity less than the first capacity to compress a refrigerant;

an indoor heat-exchanger coupled to the compressor;

an outdoor heat-exchanger coupled to the compressor;

a piping for coupling the compressor, the indoor heat-exchanger, and the outdoor heat-exchanger;

a first capillary tube provided in the piping;

a second capillary tube provided in the piping, the second capillary tube being connected in series with the first capillary tube;

a by-pass pipe connected in parallel to the second capillary tube;

a valve for opening and closing the by-pass pipe;

a controller for controlling the compressor and the valve such that the variable-capacity air conditioner operates in three stages; and a current detector for detecting a current supplied to the compressor, wherein in a first stage, the controller is programmed to (1) open the valve independent of the detected current and (2) operate the compressor at the first capacity independent of the detected current, to provide a first flow rate of the refrigerant, in a second stage, the controller is programmed to (1) open the valve when the detected current is larger than a predetermined value and (2) operate the compressor at the second capacity independent of the detected current, to provide a second flow rate of the refrigerant smaller than the first flow rate, and in a third stage, the controller is programmed to (1) close the valve when the detected current is equal to or less than the predetermined value and (2) operate the compressor at the second capacity independent of the detected current, to provide a third flow rate of the refrigerant smaller than the second flow rate.

5. A variable-capacity air conditioner comprising:

a compressor operable at a first capacity and a second capacity less than the first capacity to compress a refrigerant;

an indoor heat-exchanger coupled to the compressor;

an outdoor heat-exchanger coupled to the compressor:

a piping for coupling the compressor, the indoor heat-exchanger, and the outdoor heat-exchanger;

a first capillary tube provided in the piping;

a second capillary tube provided in the piping, the second capillary tube being connected in series with the first capillary tube;

a by-pass pipe connected in parallel to the second capillary tube;

a valve for opening and closing the by-pass pipe;

a controller for controlling the compressor and the valve such that the variable-capacity air conditioner operates in three stages; and a temperature sensor for detecting a temperature of the refrigerant in the indoor heat-exchanger, wherein in a first stage, the controller is programmed to (1) open the valve independent of the detected temperature and (2) operate the compressor at the first capacity independent of the detected temperature, to provide a first flow rate of the refrigerant, in a second stage, the controller is programmed to (1) open the valve when the detected temperature is higher than a predetermined value and (2) operate the compressor at the second capacity independent of the detected temperature, to provide a second flow rate of refrigerant smaller than the first flow rate, and in a third stage, the controller is programmed to (1) close the valve when the detected temperature is equal to or lower than the predetermined value and (2) operate the compressor at the second capacity independent of the detected temperature, to provide a third flow rate of the refrigerant smaller than the second flow rate.

6. A variable-capacity air conditioner comprising:

a compressor operable at a first capacity and a second capacity less than the first capacity to compress a refrigerant;

an indoor heat-exchanger coupled to the compressor;

an outdoor heat-exchanger coupled to the compressor:

a piping for coupling the compressor, the indoor heat-exchanger, and the outdoor heat-exchanger;

a first capillary tube provided in the piping;

a second capillary tube provided in the piping, the second capillary tube being connected in series with the first capillary tube;

a by-pass pipe connected in parallel to the second capillary tube;

a valve for opening and closing the by-pass pipe;

a controller for controlling the compressor and the valve such that the variable-capacity air conditioner operates in three stages; and a temperature sensor for detecting a temperature of the refrigerant in the outdoor heat-exchanger, wherein in a first stage, the controller is programmed to (1) open the valve independent of the detected temperature and (2) operate the compressor at the first capacity independent of the detected temperature, to provide a first flow rate of the refrigerant, in a second stage, the controller is programmed to (1) open the valve when the detected temperature is higher than a predetermined value and (2) operate the compressor at the second capacity independent of the detected temperature, to provide a second flow rate of the refrigerant smaller than the first flow rate, and in a third stage, the controller is programmed to (1) close the valve when the detected temperature is equal to or lower than the predetermined value and (2) operate the compressor at the second capacity independent of the detected temperature, to provide a third flow rate of the refrigerant smaller than the second flow rate.

7. A variable-capacity air conditioner comprising:

a compressor operable at a first capacity and a second capacity less than the first capacity to compress a refrigerant;

an indoor heat-exchanger coupled to the compressor;

an outdoor heat-exchanger coupled to the compressor;

a piping for coupling the compressor, the indoor heat-exchanger, and the outdoor heat-exchanger;

a first capillary tube provided in the piping;

a second capillary tube provided in the piping, the second capillary tube being connected in series with the first capillary tube;

a by-pass pipe connected in parallel to the second capillary tube;

a valve for opening and closing the by-pass pipe;

a controller for controlling the compressor and the valve such that the variable-capacity air conditioner operates in three stages; and a pressure detector for detecting a discharge pressure of the refrigerant discharged from the compressor, wherein in a first stage, the controller is programmed to (1) open the valve independent of the detected discharge pressure and (2) operate the compressor at the first capacity independent of the detected discharge pressure, to provide a first flow rate of the refrigerant, in a second stage, the controller is programmed to (1) open the valve when the detected discharge pressure is higher than a predetermined value and (2) operate the compressor at the second capacity independent of the detected discharge pressure, to provide a second flow rate of the refrigerant smaller than the first flow rate, and in a third stage, the controller is programmed to (1) close the valve when the detected discharge pressure is equal to or lower than the predetermined value and (2) operate the compressor at the second capacity independent of the detected discharge pressure, to provide a third flow rate of the refrigerant smaller than the second flow rate.

8. The variable-capacity air conditioner of claim 4, wherein the controller is operable to continue to open the valve for a predetermined period of time from a start-up operation of the compressor regardless of whether the compressor is operating at the first capacity or the second capacity, open the valve when the compressor operates at the first capacity after a lapse of the predetermined period of time from the start-up, and open the valve when the detected current is higher than the predetermined value while the compressor operates at the second capacity after a lapse of the predetermined period of time from the start-up, and close the valve when the detected current is equal to or lower than the predetermined value while the compressor operates at the second capacity after a lapse of the predetermined period of time from the start-up.

9. The variable-capacity air conditioner of claim 5, wherein the controller is operable to continue to open the valve for a predetermined period of time from a start-up operation of the compressor regardless of whether the compressor is operating at the first capacity or the second capacity, open the valve when the compressor operates at the first capacity after a lapse of the predetermined period of time from the start-up, and open the valve when the detected temperature is higher than the predetermined value while the compressor operates at the second capacity after a lapse of the predetermined period of time from the start-up, and close the valve when the detected temperature is equal to or lower than the predetermined value while the compressor operates at the second capacity after a lapse of the predetermined period of time from the start-up.

10. The variable-capacity air conditioner of claim 6, wherein the controller is operable to continue to open the valve for a predetermined period of time from a start-up operation of the compressor regardless of whether the compressor is operating at the first capacity or the second capacity, open the valve when the compressor operates at the first capacity after a lapse of the predetermined period of time from the start-up, and open the valve when the detected temperature is higher than the predetermined value while the compressor operates at the second capacity after a lapse of the predetermined period of time from the start-up, and close the valve when the detected temperature is equal to or lower than the predetermined value while the compressor operates at the second capacity after a lapse of the predetermined period of time from the start-up.

11. The variable-capacity air conditioner of claim 7, wherein the controller is operable to continue to open the valve for a predetermined period of time from a start-up operation of the compressor regardless of whether the compressor is operating at the first capacity or the second capacity, open the valve when the compressor operates at the first capacity after a lapse of the predetermined period of time from the start-up, and open the valve when the detected discharge pressure is higher than the predetermined value while the compressor operates at the second capacity after a lapse of the predetermined period of time from the start-up, and close the valve when the detected discharge pressure is equal to or lower than the predetermined value while the compressor operates at the second capacity after a lapse of the predetermined period of time from the start-up.

* * * * *